United States Patent [19]

Gurvitz

[11] Patent Number: 5,076,820

[45] Date of Patent: Dec. 31, 1991

[54] COLLECTOR ELECTRODE STRUCTURE AND ELECTROSTATIC PRECIPITATOR INCLUDING SAME

[76] Inventor: Alexander Gurvitz, Meltzer Street 8/7, Rehovot, Israel

[21] Appl. No.: 633,844

[22] Filed: Dec. 26, 1990

[30] Foreign Application Priority Data

Dec. 29, 1989 [IL] Israel ..... 92933

[51] Int. Cl.[5] ..... B03C 3/00

[52] U.S. Cl. ..... 55/150; 55/154

[58] Field of Search ..... 55/151, 154, 156, 150

[56] References Cited

U.S. PATENT DOCUMENTS 3,807,140 4/1974 Gurvits et al. ..... 55/154

4,869,736 9/1989 Ivester et al. ..... 55/156

*Primary Examiner*—Bernard Nozick

*Attorney, Agent, or Firm*—Benjamin J. Barish

[57] ABSTRACT

A collector electrode for an electrostatic precipitator for collecting charged particles suspended in a gas flow includes a planar base parallel to the gas flow, and a plurality of spaced projections projecting into the gas flow. Each of the projections includes an outer non-perforated section which is substantially planar and parallel to the planar base, and a perforated juncture section joining the outer section with the base.

20 Claims, 1 Drawing Sheet

COLLECTOR ELECTRODE STRUCTURE AND ELECTROSTATIC PRECIPITATOR INCLUDING SAME

FIELD AND BACKGROUND OF THE INVENTION

The present invention relates to electrostatic precipitators for removing suspended particles from a flowing gas, and more particularly to a collecting electrode structure for use in electrostatic precipitators.

Electrostatic precipitators are used for electrically separating particles suspended in a gas flow. They include charging electrodes which charge the particles suspended in the gas flow, and collector electrodes which collect the charged particles. In one known type of electrostatic precipitator involving a horizontal flow of the particle-laden gas, the collector electrodes include substantially planar bases fixed vertically substantially parallel to the gas flow and include a plurality of spaced projections projecting laterally into the gas flow. The purpose of the projections is to serve as barriers to create stagnant zones or reduced-velocity zones. Such stagnant or reduced-velocity zones decrease the re-entrainment of the collected particles back into the gas flow.

One known example of collector electrode of this type is described in U.S. Pat. No. 3,807,140, wherein the projections are perforated with apertures for the passage of the gas therethrough. The free ends of the flat projections terminate in tubular edgings in order to reduce distortions of the electric field. A disadvantage of such a construction, however, is that, in order to considerably reduce the re-entrainment of the collected particles back into the gas flow, it is necessary to use tall perforated projections. These cause excessive distortion of the electric field which decreases the efficiency of the electrostatic precipitator particularly in removing particulate matter from stack gasses.

Another known construction, as described in Russian Patent No. 784076, includes perforated projections having free ends in the shape of oval gutters formed with convex surfaces facing the direction of the charging electrodes; i.e., opposite to the direction of the collector electrode base. Such gutters are intended to diminish distortions of the electric field. However, they create vortices and powerful turbulences which increase re-entrainment and decreases the residence time of the particles.

OBJECTS AND BRIEF SUMMARY OF THE INVENTION

An object of the present invention is to provide a collector electrode for an electrostatic precipitator having advantages in the above respects. More particularly, an object of the invention is to provide a collector electrode which reduces re-entrainment, increases residence time, decreases turbulence, and/or decreases the distortion of the electric field.

Other objects are to provide an electrode assembly including a plurality of the novel collector electrodes, and also to provide an electrostatic precipitator including a plurality of the novel collector electrode assemblies.

According to the present ivention, there is provided a collector electrode for an electrostatic precipitator for collecting charged particles suspended in a gas flow and including a substantially planar base substantially parallel to the gas flow, and a plurality of spaced projections projecting into the gas flow; characterized in that each of the projections includes an outer section which is substantially planar and parallel to the planar base, and a juncture section joining the outer section with the base; the juncture section being perforated with a plurality of apertures.

According to one preferred embodiment of the invention described below, the juncture section includes a first strip joined, to the base and extending at an obtuse angle towards the outer section; and a second strip joined, and extending at a substantially right angle, to the outer section, both of the strips being formed with a plurality of apertures. In another described embodiment, the first strip of the juncture section is formed with a gradual curve.

According to further features in the described preferred embodiments, the planar outer section overlies the end of the planar base; in addition, the outer tip of the planar outer section is formed with a V-bend depending from the planar outer section and overlying the end of the planar base.

A collector electrode constructed in accordance with the foregoing features has been formed to provide a number of important advantages. Thus, such a construction enables the dimensions of the projections into the gas flow to be substantially reduced, thereby reducing turbulence and re-entrainment. Such a construction also increases the residence time of the charged particles in the area of the collector surface, thereby further reducing re-entrainment.

The invention also provides an electrode assembly including a plurality of collector electrodes as described above supported with the planar base of each electrode mounted coplanar with, but spaced from, the planar base of the adjacent electrode.

The invention also provides an electrostatic precipitator comprising a plurality of collector electrode assemblies as described above mounted vertically in parallel spaced relation to each other, with charging electrodes in the spaces between the collector electrode assemblies.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
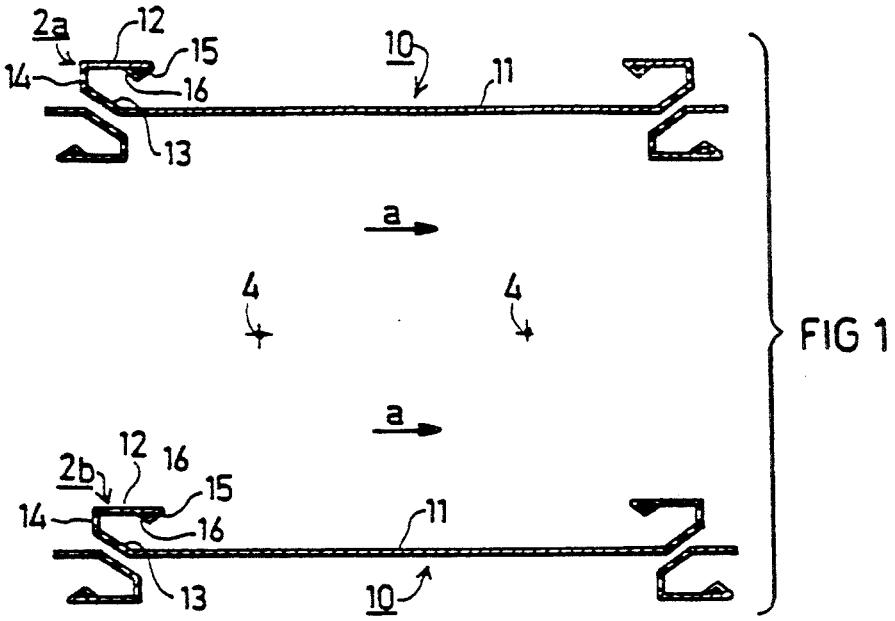
FIG. 1 is a top plan view diagrammatically illustrating one form of electrode system in accordance with the present invention for use in an electrostatic precipitator.

FIG. 1 is a top plan view diagrammatically illustrating an electrode system constructed in accordance with the present invention as used in an electrostatic precipitator for removing solid particles suspended in a gas. The electrostatic precipitator includes a plurality of electrode assemblies 2a, 2b, etc., mounted vertically in parallel spaced relation to each other, and a plurality of charging electrodes 4 (e.g., corona electrodes), located in the spaces between the collector electrode assemblies. The gas containing the solid particles to be separated is passed horizontally, in the direction indicated by arrows a. The charging electrodes 4 charge the solid particles suspended in the gas flow, and these solid particles are attracted to, and collected by, the collector electrode assemblies 2a, 2b. The so-collected particles are accumulating in hoppers (not shown) or the like by scraping, shaking, etc., as well-known in electrostatic precipitators of this type.

Each of the collector electrode assemblies 2a, 2b includes a plurality of collector electrodes, generally designated 10. Each collector electrode 10 is constituted of a planar base 11 mounted so as to be substantially parallel to the gas flow (arrow a), and a plurality of spaced projections projecting laterally into the gas flow. Each of the latter projections includes an outer section 12 substantially planar and parallel to the planar base 11, and a juncture section comprising two strips 13 and 14 joining the outer section 12 with the planar base 11 and located completely on the outer section side of the base. The two juncture strips 13, 14 are flat and are perforated with a plurality of apertures, as shown at 13a and 14a, respectively, whereas the base 11 and the outer section 12 are flat but are not perforated.

Figure 2:
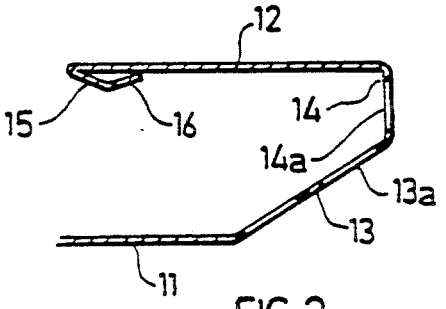
FIG. 2 is an enlarged fragmentary view illustrating the end structure of one of the collector electrodes in the system of FIG. 1.

More particularly, strip 13 is joined to the end of the planar base 11 at an obtuse angle, indicated at $\alpha$ in FIG. 2, towards the planar outer section 12. Strip 14 is joined to strip 13 also at an obtuse angle, indicated at $\beta$ in FIG. 2, whereas the other edge of strip 14 is joined to the planar outer section 12 at a substantially right angle. Angle $\alpha$ is preferably from 105°-155°; whereas angle $\beta$ may also be from 110°-160°. Particularly good results have been obtained where $\alpha$ was 135° and $\beta$145°.

Figure 3:
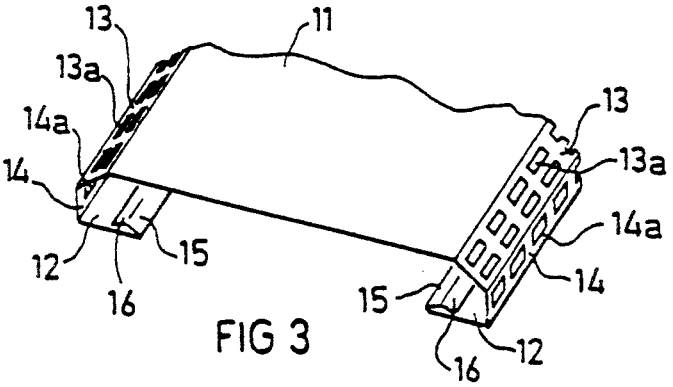
FIG. 3 is a partial three-dimensional view illustrating one of the collector electrodes in the system of FIG. 1.

The apertures 13a, 14a in strips 13, 14, are of rectangular configuration, as shown particularly in FIG. 3, but they may also be of circular or other configuration. Preferably, these apertures occupy a substantial portion, e.g., at least 30%, of the surface area of the respective strips 13, 14.

It will be seen from the drawings that a planar outer section 12 is formed at each of the two opposite ends of the planar base 11, with each such section being joined to the base by the juncture wall strips 13, 14. The planar outer sections 12 overlie the ends of the planar base 11.

As also seen in the drawings, the outer tip of each planar outer section 12 is formed with V-band, including two strips 15, 16, depending from the planar outer section 12 and overlying the end of the planar base 11.

The operation of the electrode system illustrated in FIGS. 1-3 will be apparent from the above description. Thus, the particle-laden gas is circulated horizontally through the spaces between the electrode assemblies 2a, 2b, while the corona electrodes 10 charge the particles and thereby cause them to be attracted towards, and collected by, the collector electrodes in assemblies 2a, 2b. Periodically, the collected particles are removed into hoppers or the like by scrapers or shaking, as known.

It has been found that the collector electrode structure illustrated in the drawings decreases the turbulence, and increases the residence time at which the charged particles remain near the collector surface. Such an electrode structure thus decreases the reentrainment of the collected particles back into the gas flow, and allows the gas velocity to be increased. The described collector electrode also reduces the disturbance of the electrode system on the the electric field. Electrodes constructed as illustrated in the drawings have been tested, and have shown that such a construction allows the dimensions and cost of the electrode system to be reduced substantially, as much as one third.

Figure 4:
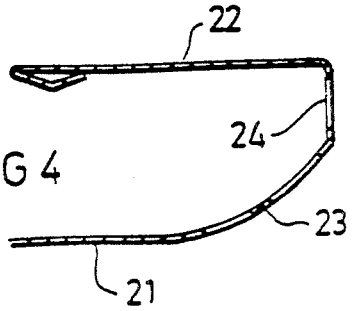
FIG. 4 is a fragmentary view illustrating a modification in the construction of the collector electrodes in the system of FIG. 1.

FIG. 4 illustrates a variation in the construction of the projections at the ends of the planar base electrodes, therein indicated at 21. In this modification, the opposite ends of the planar base electrode 21 are joined to the outer planar sections 22 by a somewhat curved juncture section including strips 23, 24. As shown particularly in FIG. 4, strip 23 is gradually curved as a continuation of the planar base 21, whereas strip 24 is flat and is joined to the outer planar section 22 by a right angle. In the modification of FIG. 4, the outer tip of the planar outer section 22 is also formed with a V-bend, comprising strips 25 and 26 depending from section 22 and overlying the end of thae planar base 21.

While the invention has been described with respect to two preferred embodiments, it will be appreciated that many other variations, modifications and applications of the invention may be made.

What is claimed is:

1. A collector electrode for an electrostatic precipitator for collecting charged particles suspended in a gas flow and including a substantially planar base substantially parallel to the gas flow, and a plurality of spaced projections projecting into the gas flow; each of said projections includes an outer section which is substantially planar and parallel to the planar base, and a juncture section joining the outer section with the base; said juncture section being perforated with a plurality of apertures.

2. The collector electrode according to claim 1, wherein each of the opposite ends of the planar base is formed with one of said projections.

3. The collector electrode according to claim 1, wherein said perforated juncture section is formed with apertures occupying at least one-third of the area of said juncture section.

4. The collector electrode according to claim 1, wherein said juncture section includes a first strip joined to the base, and extending at an obtuse angle towards said outer section, and a second strip joined, and extending at a substantially right angle, to said outer section, both of said strips being perforated with a plurality of apertures.

5. The collector electrode according to claim 4, wherein said first strip is formed with a gradual curve.

6. The collector electrode according to claim 4, wherein both said strips are flat, said first strip being at an angle of 105°-155° with respect to said base, and said second strip being at an angle of 110°-160° with respect to said first strip.

7. The collector electrode according to claim 6, wherein said first strip is at an angle of about 135° with respect to said base, and said second strip is at an angle of about 145° with respect to said first strip.

8. The collector electrode according to claim 1, wherein said planar outer section overlies the end of the planar base.

9. The collector electrode according to claim 8, wherein the outer tip of said planar outer section is formed with a V-bend depending from the planar outer section and overlying the end of said planar base.

10. A collector electrode for an electrostatic precipitator for collecting charged particles suspended in a gas flow and including a substantially planar base substantially parallel to the gas flow, and a plurality of spaced projections projecting into the gas flow; each of said projections including an outer section which is substantially planar and parallel to the planar base, and a juncture section joining the outer section with the base and located completely on the outer section side of said base; said juncture section forming a substantially right angle with said planar outer section and being perforated with a plurality of apertures.

11. The collector electrode according to claim 10, wherein said perforated juncture section is formed with apertures occupying at least one-third of the area of said juncture section.

12. The collector electrode according to claim 10, wherein said juncture section includes a first strip joined, and extending at an obtuse angle, to the base, and a second strip joined, and extending at a substantially right angle, to said outer section, both of said strips being perforated with a plurality of apertures.

13. The collector electrode according to claim 12, wherein both said strips are flat, said first strip being at an angle of 105°–155° with respect to said base, and said second strip being at an angle of 110°–160° with respect to said first strip.

14. The collector electrode according to claim 12, wherein said first strip is formed with a gradual curve.

15. The collector electrode according to claim 10, wherein said planar outer section overlies the end of the planar base.

16. The collector electrode according to claim 15, wherein the outer tip of said planar outer section is formed with a V-bend depending from the planar outer section and overlying the end of said planar base.

17. An electrostatic precipitator for collecting charged particles suspended in a gas flow comprising:

a plurality of collector electrodes mounted vertically in parallel spaced relation to each other;

each of said collector electrodes including a substantially planar base substantially parallel to the gas flow, and a plurality of spaced projections projecting into the gas flow; each of said projections includes an outer section which is substantially planar and parallel to the planar base, and a juncture section joining the outer section with the base, and a juncture section joining the outer section with the base; said juncture section including a first strip joined, and extending at an obtuse angle, to the base, and a second strip joined, and extending at a substantially right angle, to said outer section, both of said strips being perforated with a plurality of apertures;

and charging electrodes in the spaces between said collector electrodes.

18. The electrostatic precipitator according to claim 17, wherein said juncture section includes a first strip joined, and extending at an obtuse angle, to the base, and a second strip joined, and extending at a substantially right angle, to said outer section, both of said strips being flat and perforated with a plurality of apertures, said first strip being at an angle of 105°–155° with respect to said base, and said second strip being at an angle of 110°–160° with respect to said first strip.

19. The electrostatic precipitator according to claim 17, wherein said juncture section includes a first strip formed with a gradual curve located completely on the outer section side of said base, and a second strip joined, and extending at a substantially right angle, to said outer section, both of said strips being perforated with a plurality of apertures.

20. The electrostatic precipitator according to claim 17, wherein said perforated juncture section is formed with apertures occupying at least one-third of the area of said juncture section.

* * * * *